US009162850B2

(12) United States Patent
Hopp et al.

(10) Patent No.: US 9,162,850 B2
(45) **Date of Patent: *Oct. 20, 2015**

(54) ELEVATOR SHAFT CLOSURE DOOR FRAME WITH CONTROL ARRANGEMENT

(75) Inventors: Roman Hopp, Udligenswil (CH); Christian Lüthi, Hausen (CH); Manuel Teixeira Pinto Dias, Locarno (CH)

(73) Assignee: Inventio AG, Hergiswil (CH)

( * ) Notice: Subject to any disclaimer, the term of this patent is extended or adjusted under 35 U.S.C. 154(b) by 727 days.

This patent is subject to a terminal disclaimer.

(21) Appl. No.: 13/483,650

(22) Filed: May 30, 2012

(65) Prior Publication Data

US 2012/0305337 A1 Dec. 6, 2012

(30) Foreign Application Priority Data

May 30, 2011 (EP) ..... 11168022

(51) Int. Cl.
*B66B 13/14* (2006.01)
*B66B 13/30* (2006.01)
*B66B 11/00* (2006.01)

(52) U.S. Cl.
CPC ..... *B66B 13/306* (2013.01); *B66B 11/001* (2013.01)

(58) Field of Classification Search
CPC ..... B66B 11/001; B66B 13/306
USPC ..... 187/251, 272, 277, 314, 316, 391, 414, 187/247, 276, 317, 336, 340, 380, 393, 395, 187/396, 337, 413; 49/12, 26, 28, 116; 52/30, 127.8, 173.1, 204.1, 656.1, 52/656.6
See application file for complete search history.

(56) References Cited

U.S. PATENT DOCUMENTS

| | | | | |
|---|---|---|---|---|
| 5,740,888 | A * | 4/1998 | Aulanko et al. | 187/336 |
| 6,230,845 | B1 * | 5/2001 | Yamakawa et al. | 187/391 |
| 6,336,523 | B1 * | 1/2002 | Ozeki et al. | 187/391 |
| 6,378,660 | B1 * | 4/2002 | Adifon et al. | 187/272 |
| 6,484,850 | B1 * | 11/2002 | Kobayashi et al. | 187/414 |
| 6,488,129 | B2 * | 12/2002 | Lamb | 187/414 |
| 7,114,594 | B2 * | 10/2006 | Rossignol et al. | 187/336 |
| 7,398,861 | B2 * | 7/2008 | Rossignol et al. | 187/314 |
| 2012/0305337 | A1 * | 12/2012 | Hopp et al. | 187/336 |
| 2014/0224591 | A1 * | 8/2014 | Garcia | 187/251 |

FOREIGN PATENT DOCUMENTS

| | | | |
|---|---|---|---|
| EP | 0680921 | A2 | 11/1995 |
| EP | 1046604 | A1 | 10/2000 |
| EP | 1518815 | A1 | 3/2005 |
| EP | 1562849 | A1 | 8/2005 |
| JP | 2004-250210 | A | 9/2004 |
| WO | 2004/046010 | A1 | 6/2004 |

* cited by examiner

*Primary Examiner* — Anthony Salata
(74) *Attorney, Agent, or Firm* — Fraser Clemens Martin & Miller LLC; William J. Clemens

(57) ABSTRACT

A door frame of an elevator shaft closure has a chamber in which an elevator control arrangement is arranged. The elevator shaft closure separates an elevator shaft of a building from a story of the building. The elevator control arrangement includes an elevator control unit and at least one electronic power unit, which is connectible with an elevator motor.

18 Claims, 6 Drawing Sheets

20.3 ELECTRONIC COMPONENT
21.3 ELECTRONIC COMPONENT
21.4 ELECTRONIC COMPONENT
75 MONOSTABLE CONTACT OR RELAY
75.1 REGULATING DEVICE
90 POWER MAINS

ELEVATOR SHAFT CLOSURE DOOR FRAME WITH CONTROL ARRANGEMENT

CROSS-REFERENCE TO RELATED APPLICATION

This application claims priority to European Patent Application No. 11168022.9, filed May 30, 2011, which is incorporated herein by reference.

FIELD

The disclosure relates to a door frame of an elevator shaft closure.

BACKGROUND

EP 1 518 815 A1 discloses an elevator shaft closure of a building with a door frame fastened in the building and with movable doors. The elevator shaft closure separates an elevator shaft of the building from a story of the building, wherein an elevator control arrangement is located in a chamber of the door frame. The location of the elevator control arrangement within the door frame is made possible in that, inter alia, currently the elevator control arrangement can be of smaller construction and the power consumption as well as the resulting waste heat could be reduced and thereby, for example, space-depriving ventilating installations are not required. An elevator control arrangement can comprise, as disclosed in EP 1 518 815 A1, an elevator control unit and means for mounting and protection of the elevator control unit. The elevator control arrangement is therefore mountable in and demountable from an elevator installation as an entire component with few actions.

The elevator control unit substantially comprises subassemblies required for control and/or regulation of the elevator installation. In addition, such an elevator control unit can include interfaces and input modules necessary for servicing the elevator installation and for diagnosis and can comprise a power supply unit for voltage supply.

Door frame elements of elevator installations sometimes have very small cross-sections. In existing elevator installations the dimensions of these cross-sections are seldom more than 0.1 meters×0.15 meters.

In elevator installations the elevator motor thereof is often arranged in the elevator shaft itself. Also needed for operation of the elevator motor is an electronic power unit which is activated by control signals of the elevator control unit. The elevator motor arranged in the elevator shaft is connected with the power mains by way of the electronic power unit. In elevator installations of that kind the elevator control arrangement is usually located in a region of an elevator shaft closure. The electronic power unit is normally part of a frequency converter, which is usually arranged in the elevator shaft in the vicinity of the elevator motor. This is because electronic power units sometimes generate a considerable amount of waste heat. Moreover, electric and/or magnetic fields thereof or electric and/or magnetic waves sensitively disturb the elevator control unit. In addition, electromechanical relays which can produce a considerable amount of switching noise are arranged in the elevator shaft between the electronic power unit and power mains. The choke coils of the electronic power unit can also generate a considerable amount of operating noise and accordingly due also to this noise the electronic power unit is sometimes arranged in the elevator shaft. However, this location can require a high outlay on installation and material.

SUMMARY

At least some embodiments comprise a door frame with an elevator control arrangement which is simple to maintain and check and which needs small outlay on installation and material.

Further embodiments comprise a door frame with an elevator control unit or an elevator shaft closure with the door frame, or an elevator installation with at least one elevator shaft closure.

In some embodiments, a door frame of an elevator shaft closure has a chamber in which an elevator control arrangement is arranged. The elevator shaft closure separates an elevator shaft of a building from a story of the building. The elevator control arrangement includes an elevator control unit and at least one electronic power unit, which is connectible with an elevator motor.

The construction of the chamber can depend on the selection of the profile cross-sections which the door frame elements have. Insofar as the door frame is formed from tubular sections, the chamber is arranged in the interior of the door frame profile. Insofar as the door frame is formed from angle sections and/or U-sections, a side wall of the chamber can also be formed by the masonry of the building. In order to simplify maintenance, the elevator control arrangement can be installed in a vertical door frame element or in the door post. The chamber volume is sometimes limited by the small cross-section of the door frame of less than or equal to 0.1 meters×0.15 meters.

In particular embodiments, an elevator shaft closure of a building comprises, as stated in the foregoing, a door frame, which is fastened in the building, with a chamber in which the elevator control arrangement is arranged integrated with the electronic power unit or with the frequency converter. In addition, guided at the door frame are movable doors which also belong to the elevator shaft closure. An elevator installation of a building comprises at least one elevator shaft closure with the elevator control arrangement.

BRIEF DESCRIPTION OF THE DRAWINGS

The disclosed technologies are explained in more detail in the following by way of examples and with reference to the drawings, in which.

DETAILED DESCRIPTION

Figure 1:
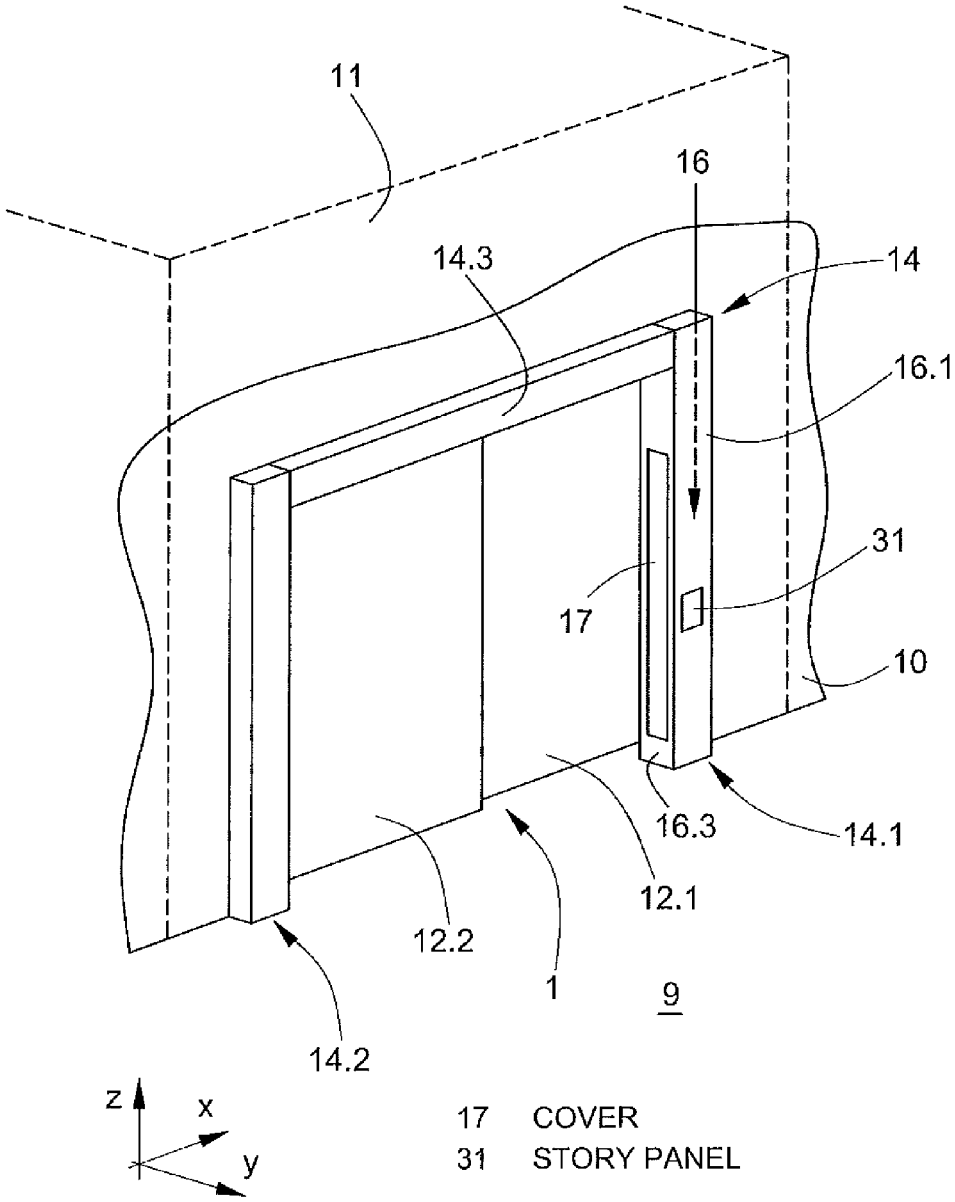
FIG. 1 shows an elevator shaft closure in three-dimensional view with a door frame and an elevator control arrangement, arranged in a chamber of the door frame.

The characteristics expressed in the following have led to prejudices that the integration of the electronic power unit in an elevator control arrangement arranged in the chamber of a door frame is largely rejected by the expert world. The waste heat of individual electronic components of the elevator control arrangement, particularly the electronic components of the electronic power unit, in the physically narrow chamber of the door frame could have the consequence that the reliability of these and further electronic components of the elevator control arrangement is impaired. Thus, the electronic components can overheat due to heat build-up and be destroyed or the waste heat can have the consequence that the electronic components operate outside the permissible operating temperature and this leads to faults in the processing of signals. Moreover, excessive operating noise of relays and choke coils are generally not desired by operators, building occupiers and users of an elevator installation when these noises are audible on the story.

Possible advantages of at least some embodiments of integration of the electronic power unit in the elevator control arrangement can, however, be manifold. Firstly, the costs can be substantially reduced, since only wiring of the motor still has to be connected with the elevator control arrangement and the elevator control arrangement with the electric power mains. In addition, a separate power supply line between the elevator control arrangement and the power mains is not necessary, since the power supply unit of the elevator control arrangement supplies the elevator control unit and the electronic power unit. Secondly, the elevator control unit and the electronic power unit can be matched and adjusted to one another at the conclusion of factory assembly of the elevator control arrangement. Further, the entire elevator control arrangement can be checked at the factory. This can mean that costly adjustment work during assembly, repair or maintenance of an elevator installation is redundant. The entire elevator control arrangement and thus the elevator control unit and the electronic power unit can be exchanged by a few actions.

The integration of the electronic power unit in the elevator control arrangement can dispose of the prejudice that the heat output of the electronic power unit and emission by that of disturbing influences are too substantial for the elevator control unit to be arranged in the narrowest space in the chamber of the door frame. Since the waste heat is dissipated by suitable means into the elevator shaft and the units are skillfully arranged relative to one another in the elevator control arrangement with utilization of the surrounding components, integration is made possible. Moreover, due to the skillful arrangement of the components with utilization of the surrounding components the air draft present in the elevator shaft is employed for conducting away waste heat. This air draft arises particularly as a consequence of movements of one or more elevator cages and counterweights in the elevator shaft.

In at least some embodiments, as far as possible, the conducting away of waste heat should not take place by way of the door frame itself, since otherwise this would heat up. Through dissipation of the waste heat into the elevator shaft the door frame has approximately room temperature and the user is not discomfited by a heated door frame. The waste heat of the elevator control unit can also be dissipated into the elevator shaft.

The elevator control arrangement can also be accessible from the elevator shaft. In order to achieve this the door frame can include, in the region of the chamber, an opening oriented towards the elevator shaft. The elevator control arrangement comprises a main member at which the elevator control unit and the electronic power unit are arranged. In the installed state the opening is closed by the main member. The opening can be closed so that no gases from fire can penetrate and in the case of fire the fire does not propagate via the elevator shaft and the opening in the door frame into the story. The feature "arranged at the main member" means that the unit is arranged in the immediate vicinity of the main member. The electronic power unit and the elevator control unit therefore do not necessarily have to lie on the surface of the main member. They can be connected with the wall by means of spacers or, for example, held at a defined spacing parallel to the wall by a mounting bracket fastened to the main member.

A first possibility of dissipating waste heat into the elevator shaft consists in arranging at least one passage in the main member. A cooling body of an electronic component of the electronic power unit, the elevator control unit or a radiator of a cooling system extends through this passage into the elevator shaft when the main member is installed in the door frame. In order to prevent propagation of gases of fire by way of the elevator shaft the at least one passage of the main member is gas-tightly closed by the cooling body or radiator which reaches through or by sealing elements.

The second possibility of dissipating waste heat into the elevator shaft consists in thermally conductively connecting at least one cooling body of an electronic component of the electronic power unit, the elevator control unit or the cooler of a cooling system with the main member and transferring its waste heat to the member. The main member itself has a high thermal conductivity and includes cooling ribs oriented towards the elevator shaft when the main member is installed in the door frame. In order that the waste heat is not transmitted to those door frame parts which face the story, an insulating material, for example a heat-resistant seal which encircles edges of the opening, can be provided between the contact surfaces of the door frame parts and the main member. The cooling body of an electronic component or the cooler of a cooling system can have any form suitable for transferring heat to the main member. For example, the cooling body or cooler can have a flat, smooth contact surface which is pressed by suitable fastening means against a flat, smooth contact surface of the main member. When cooling bodies and radiators extend through the main member these can have cooling slats extending in the elevator shaft.

In the present specification there is to be understood by "cooling system" a device which is arranged in the chamber and assists thermal transport of the waste heat of electronic components of the elevator control arrangement to the main member and/or a radiator extending through the main member. Use can be made of cooling systems which operate with lowest possible noise. Such a cooling system can be, for example, a heat pipe, a pump-driven coolant circuit or a Peltier element. The Peltier element could, for example, be operated by the brake energy of the elevator motor instead of eliminating this by way of a braking resistor. In addition, a throughflow cooling system connected with a water mains of the building could obviously also be integrated in the main member, but for economic and ecological reasons this is less feasible.

Since the cooling ribs of the main member or the cooling slats of the cooling body or radiator extend in the elevator shaft these are engaged by the air draught of at least one elevator cage moving in the elevator shaft and efficiently cooled. In order to better utilize the cooling effect of the elevator draught, the flow direction of which takes place substantially in the length direction of the elevator shaft, the cooling ribs of the main member or the cooling slats of the cooling body or radiator can be designed and arranged in suitable manner. For example, these can be arranged in the length direction thereof at an angle between 1° and 60° to the movement direction of the elevator cage arranged in the elevator shaft.

The chamber can comprise electrically conductive chamber walls, which are part of the mutual screening of electric and/or magnetic fields and electric and/or magnetic waves of the elevator control unit and the electronic power unit. If the door frame is made from an electrically conductive tube section, this already results. In a given case, screening plates and/or screening films can be arranged in the chamber if a side of the chamber is bounded by the masonry of the building.

By "part of the mutual screening" there is meant that the conductive chamber wall contributes to the screening of the electromagnetic disturbing influences of the respective other units, but does not necessarily completely manage this. Through skillful arrangement of the elevator control unit and the electronic power units at the main member the number of additional screening means can be minimized. By "unit" there is not necessarily meant a physical unit; for example, an electronic power unit can also comprise a plurality of circuit-boards connected together by connecting lines and equipped with electronic components. The term "unit" thus refers to the function of a component or a group of components. The same also applies to "elevator control unit" or "power supply unit".

An electrically conductive screening cover, a screening hood, a screening housing or at least one chamber intermediate wall can serve as screening means. The electronic power unit and/or the elevator control unit can be completely enclosed by electrically conductive parts serving as screening means. An exception can be the cooling bodies or radiators projecting into the cooling air channel, which for the purpose of optimum heat dissipation should be in contact with the cooling air flow. The electrically conductive walls can be made of sheet steel, aluminum or a soft-magnetic nickel-iron alloy of high magnetic permeability or be coated by these materials.

In some embodiments, at least one of the following units generating waste heat can be arranged at the main member:

- a power supply unit (transformer with rectifier) for power supply of the elevator control unit,
- a power supply unit for power supply of batteries and
- a further electronic power unit, for example for feedback to a power mains of the electrical energy generated by the elevator motor.

The second electronic power unit is, in at least some embodiments, only necessary if the first electronic power unit is not capable of feedback or if the recuperated electrical energy thereof is utilized for charging batteries. The braking energy of the elevator motor is thus not simply converted by means of heat resistors into heat, but is exploited. At least some of the afore-mentioned units similarly generate substantial amounts of waste heat in the narrow chamber, so that the waste heat thereof also has to be dissipated into the elevator shaft by the main member or by the cooling bodies and/or radiators extending through the main member.

According to European Standard EN 81, in which the safety regulations for construction and installation of elevators are defined, two independent switching elements are required in order to interrupt the energy flow between elevator motor and the power mains. These switching elements can be, for example, relays, which can be similarly arranged in the chamber of the door frame.

Correspondingly, the elevator control arrangement can comprise at least one relay which is arranged between the power mains and the electronic power unit. In order to minimize the switching noise of the at least one relay, the elevator control arrangement can comprise a regulating device which regulates the supply voltage of the switching coil of the relay in dependence on the amperage to be switched.

The electronic power unit for operating an elevator motor can be part of an electronic frequency converter. In principle, the electronic power unit of an electronic (static) frequency converter comprises a rectifier, which feeds a direct-current or direct-voltage intermediate circuit, and an inverter fed by this intermediate circuit. Moreover, the frequency converter can additionally comprise further electronic components, for example pulse-width modulation means for activation of the inverter in order to produce the output frequency thereof, memory modules for storage of data, a power supply unit for power supply of further electronic components and more of the same.

The intermediate circuit consists of a capacitor for smoothing the direct voltage and an inductance for interference suppression. As rectifier, use is made in that case of not only uncontrolled, but also controlled bridges. The feed of the intermediate circuit can also take place, in the case of use of a controlled bridge, with an active power factor correction (PFC). The inverter operates with electronic power switches (controlled bridges). These can be, inter alia, transistors such as metal-oxide semiconductor field-effect transistors (MOSFETs), insulated gate bipolar transistors (IGBTs) or switching thyristors (integrated gate commutated thyristors, IGCTs). The level of the resulting output voltage and also the frequency thereof can be regulated within wide limits.

In order to be able to brake, simple frequency converters have a so-called brake chopper, which conducts excess energy from the intermediate circuit to a braking resistor and there converts it into heat. The intermediate circuit voltage would otherwise rise and destroy the capacitors.

However, there are also other frequency converters with feedback capability, which can feed the collected generated braking power back into the power mains.

Moreover, there are direct converters (so-called matrix converters) in which, by way of semiconductor switches, each phase of the power supply mains can be directly connected with each phase of the load. The intermediate circuit with commensurability is thus redundant. A direct converter with thyristors can, however, generate only output frequencies smaller than the input frequency. Intermediate circuit converters and direct converters with IGBTs can, thereagainst, also produce output frequencies lying above the input frequency. Direct converters similarly have feedback capability.

Frequency converters produce strong electrical interference signals on the motor feed line, which not only can disturb other consumers, but also can lead to increased loading of insulation in the motor. The motor feed line usually has to be shielded for avoidance of interfering radiation. Assistance can also be provided by a so-called sine filter between the frequency converter and the elevator motor. Such sine filters differ from a mains filter by their lower limit frequency and higher load-bearing capability.

If the frequency converter is in a position of transferring, in both rotational directions, energy from the intermediate circuit to the motor and, during braking, also back to the intermediate circuit this is termed four-quadrant operation. Since the intermediate circuit due to its construction can store only a certain amount of energy without destruction, measures for reducing the stored energy have to be undertaken. A variant which is used mostly with low-cost frequency converters is the conversion of the electrical energy into thermal energy by the already mentioned brake chopper, which is switched on by an electronic switch. However, in the case of larger amounts of energy this method is undesirable due to ecological and also economic reasons. The waste heat of the brake chopper is, moreover, of such a magnitude that this cannot be accommodated in the chamber of the door frame. Frequency converters with feedback capability are therefore particularly suitable for at least some embodiments. They can transfer the energy from the intermediate circuit back to the power supply mains. All kinds of motors with frequency converters having feedback capability can thus be used as generators even in the case of changing rotational speeds. This is of interest particularly also for drives of escalators and moving walkways.

Instead of a second relay the two isolating points between the power supply mains and the elevator motor required by EN 81 can be realized by one relay and by blocking of IGBTs at the motor side. The relay is arranged between the power supply mains and the frequency converter and the IGBTs at the motor side between the intermediate circuit and the elevator motor. In order to ensure separation the state of the relay is interrogated by a constrainedly guided auxiliary contact and the activation pulse of the motor-side IGBTs blocked. This functionality is checked not by safety elements on the hardware side, but by a software faulty-function test (EN 81 test).

It is also possible to completely dispense with the use of relays. In order to achieve this, the direct voltage circuit of the frequency converter can be regulated or controlled by an electronic power switch, possibly an intermediate circuit IGBT. For that purpose use is made of a signal, which is modulated in pulse width, of a signal generator. Instead of the relay arranged between the frequency converter and the power source, use can now be made of the intermediate circuit IGBT for interrupting the energy flow. As required by EN 81, the two separating points are realized by blocking of the intermediate circuit IGBT and by blocking of the motor-side IGBT. In order to ensure the double separation, firstly the voltage across the intermediate circuit IGBT and/or the current through this is or are measured and monitored and the activation signals of all IGBTs (intermediate circuit and at the motor side) are blocked. Replacement of the relays by an appropriately designed frequency converter can have the following advantages for at least some embodiments:

- a higher reliability or contact certainty, since by contrast to the relay no contacts can stick,
- no switching noise,
- less complex wiring (power and fine wiring),
- simplification of the EMV concept, since the IGBT can, in the intermediate circuit, be directly integrated in the conductor tracks,
- reduced need for space and
- reduced energy consumption and consequently smaller output of heat.

A further source of noise can be choke coils. The metal core thereof usually consists of metal core plates which are clamped to form a plate stack. However, the clamping is usually not sufficient to prevent mutual vibration of these metal core plates when the choke coil is acted on, for example, by alternating current. In order to keep the noise output in the door frame as low as possible the elevator control arrangement can have at least one choke coil, the metal core plates of which are welded together or the gaps between the metal core plates are filled with a synthetic material casting compound.

An elevator shaft closure 1 of an elevator installation is illustrated in FIG. 1 in the way it can be perceived by a user of the elevator installation on a story 9. A building (not illustrated in more detail) in which the elevator installation is located comprises a building wall 10 which bounds an elevator shaft 11 indicated by dashed lines.

The elevator shaft 11 is separated from the story 9 by the elevator shaft closure 1. The elevator shaft closure 1 comprises a shaft door consisting substantially of two door leaves 12.1, 12.2 and a door frame 14. The door leaves 12.1, 12.2 are horizontally displaceable and, in particular, in the direction of an axis X of an orthogonal three-dimensional co-ordinate system, which is shown in FIG. 1, with the further axes Y and Z. The door frame 14 comprises three door frame elements, namely two lateral vertical door frame elements 14.1, 14.2, which form door posts and are oriented parallel to the axis Z, and an upper horizontal door frame element 14.3, which is oriented parallel to the axis X.

A chamber 16 is formed by the vertical door frame element 14.1 in the interior thereof. The vertical door frame element 14.1 has a plurality of post walls, in particular an outer front post wall 16.1 and an outer lateral post wall 16.3. In the present embodiment the outer front post wall 16.1 lies parallel to a plane formed by the axes X and Z and the outer lateral post wall 16.3 parallel to a plane formed by the axes Y and Z. The outer front post wall 16.1 and the outer lateral post wall 16.3 face the story 9. In addition to the outer post walls 16.1 and 16.3, inner post walls, which are explained in more detail in connection with FIGS. 2 and 3, can be present.

The outer lateral post wall 16.3 has an external opening, which enables access to the chamber 16. This external opening can have any suitable size, in particular it can extend over the largest part of the lateral post wall 16.3 as is indicated in FIG. 1. The external opening can also be formed in the outer front post wall 16.1.

The external opening is closable by a cover 17. If the elevator installation is ready for operation or is in operation, then the cover 17 is mounted in its operating position in which it closes the external opening. If the elevator installation is in servicing mode, then the cover 17 is in its service position, in which it is completely demounted, i.e. without contact with the vertical door frame element 14.1. Alternatively, the cover 17 can also be fastened to the vertical door frame element 14.1 by means of a hinge. The cover 17 is possibly let by its outer surface flush into the external opening, whereby it is fastened to be virtually vandal-proof and has an aesthetically pleasing appearance. It is possible to dispense with the external opening and the cover 17 if access to the chamber 16 from the direction of the story 9 is not required. Dispensing with the external opening and the cover 17 can have, in particular, advantages with respect to fire protection.

The outer front post wall 16.1 has a passage in which a story panel 31 is mounted, wherein the same story panel 31 can be used on all stories of the elevator installation. The story panel 31 can also be let into the cover 17. The story panel 31 can comprise simple upward/downward selector buttons, a destination call control, user identification reader, a touch-screen with a graphic user surface and more of the like.

Figure 2:
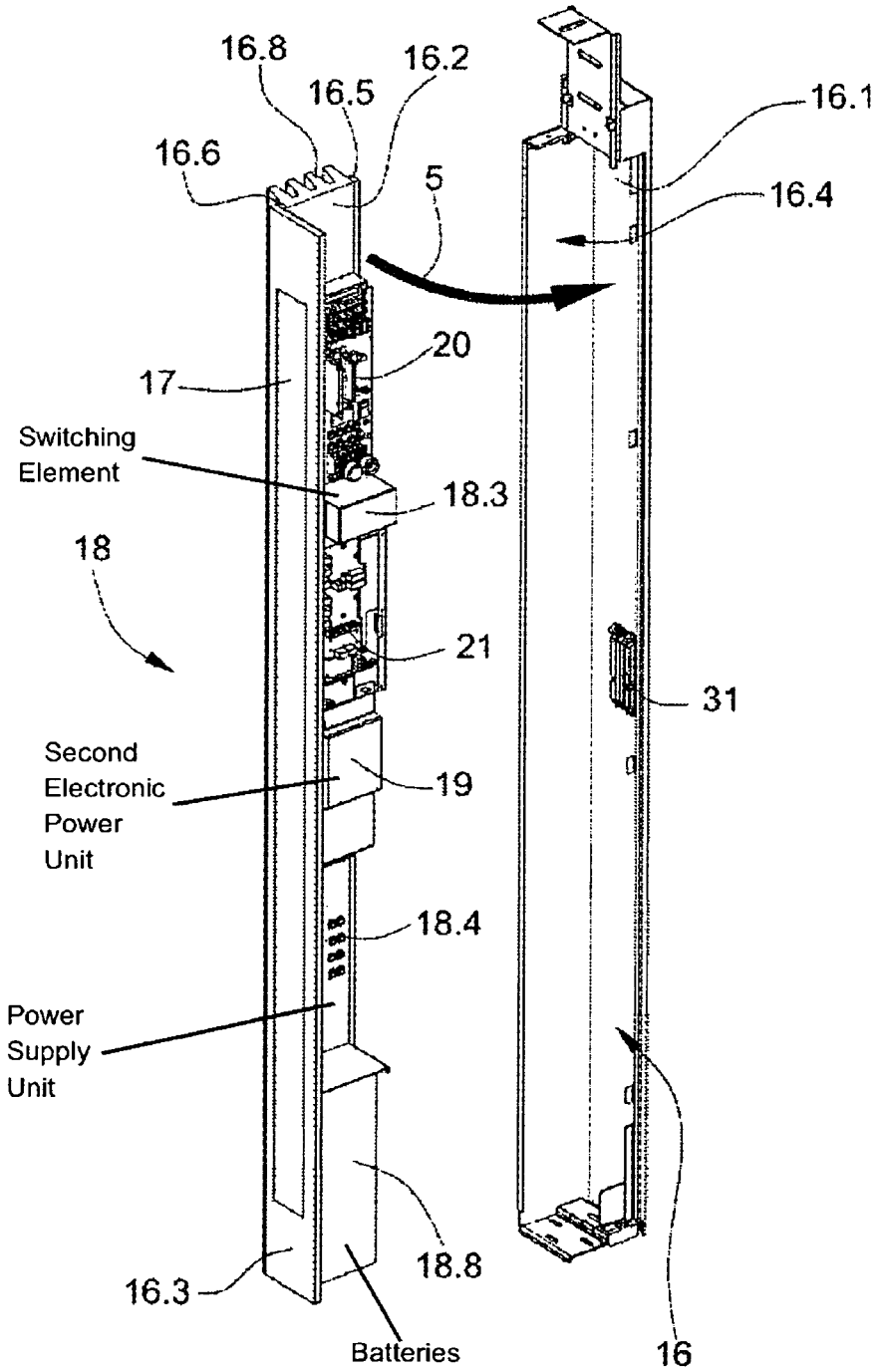
FIG. 2 shows door post parts of the door frame of FIG. 1 in three-dimensional exploded illustration, which form the chamber, as well as the elevator control arrangement in a first embodiment.

FIG. 2 shows door post parts of the door frame 14 of FIG. 1 in a three-dimensional exploded illustration. The features already described in FIG. 1 have the same reference numerals. In FIG. 2 the viewing direction is not oriented from the story 9, but from the elevator shaft 11 onto the door posts. The outer front post wall 16.1 is therefore seen from behind.

Similarly, the story panel 31 can be seen from behind. The outer lateral post wall 16.3 is connected with the outer front post wall 16.1 and the external opening thereof closed by the cover 17. The outer front post wall 16.1 is formed by means of flanging an inner lateral post wall 16.4. This inner lateral post wall 16.4 is oriented towards the masonry of the building wall 10 when the door frame 14 is, as illustrated in FIG. 1, let into the masonry opening of the building wall 10. By virtue of the construction with the afore-described post walls 16.1, 16.3, 16.4, by which the door frame 14 has a U-shaped cross-section in the region of the door post, the chamber 16 has an opening directed towards the elevator shaft 11. This opening, or the chamber 16 formed by the door post part 16.1, 16.3 and 16.4, is closed by a main member 16.2 of an elevator control arrangement 18 in a first embodiment. All remaining parts of the elevator control arrangement 18 are so arranged at the main member 16.2 that in the installed state these are disposed with in the chamber 16. For the sake of better clarity the outer lateral post wall 16.3 is connected with the main member 16.2 and, as shown by the arrow 5, illustrated turned through 90°.

The main member 16.2 is thermally decoupled from the adjoining post walls 16.3, 16.4 by means of strips of insulating material 16.5, 16.6. If the post walls 16.1, 16.3, 16.4 are made from steel alloys with a high chromium content, i.e. so-called stainless steels, the use of the strips of insulating material 16.5, 16.6 is redundant, since these steel alloys have a very low thermal conductivity.

If the elevator control arrangement 18 has to be exchanged it can be completely demounted from the post walls 16.1, 16.3 and 16.4 from the side of the elevator shaft 11 by detaching the main member 16.2. For that purpose, the elevator cage (not illustrated) can be moved to a suitable height between two stories 9 so that an operative standing or crouching on the roof of the elevator cage or on a work surface of an elevator cage can perform the necessary work.

The elevator control arrangement 18 substantially comprises the following subassemblies:

- the main member 16.2,
- an elevator control unit 20 fastened to the main member 16.2,
- an electronic control unit 21, which is fastened to the main member 16.2, for operating an elevator motor (feed and optionally feedback),
- an optional second electronic power unit 19 for feedback of the electrical energy generated by the elevator motor,
- a power supply unit 18.4 for power supply of the elevator control unit 20 and/or batteries 18.8,
- optional cooling means for cooling the units 20, 21 generating waste heat, wherein the waste heat is dissipated into the elevator shaft 11,
- optionally one or more switching elements 18.3, for example a relay,
- fastening means for installation of the main member 16.2 in the chamber 16,
- cables for power supply and for creating the connections to story panels 31 and for connection with the elevator motor,
- an optional electrical or electromagnetic monitoring of the cover 17,
- an optional lighting of the chamber 16,
- screening means such as screening covers, screening plates or screening hoods, and
- apparatus used for emergency evacuation, for example batteries 18.8.

In further embodiments the elevator control unit 20 comprises the following elements:

- hardware and software of the elevator control (for example, a host computer with logic elements and interfaces) and
- tele-alarm system and/or intercom (for example, in order to be able to place a service call or emergency call).

Various means can be employed for discharging the waste heat into the elevator shaft 11. For example, through a skillful selection and arrangement of the units 20, 21 the waste heat thereof can be transmitted to the main member 16.2, which in turn delivers the waste heat to the air in the elevator shaft 11. If due to the restricted area of the main member 16.2 facing the chamber 16 not all units generating waste heat can be directly arranged on the main member 16.2, various possibilities are available. These possibilities are explained in more detail in the description of FIGS. 4 and 5. If the cooling performance of the main member 16.2 as a flat plate should not suffice, cooling ribs can be provided. The main member 16.2 illustrated in FIG. 2 has such cooling ribs 16.8, which are arranged parallel to the longitudinal direction of the main member 16.2. The illustrated main member 16.2 can be formed monolithically as an extruded aluminum section inclusive of the cooling ribs 16.8. The cooling ribs 16.8 could also be produced as individual parts and connected with the main member 16.2 by way of fastening means or material couple.

Figure 3:
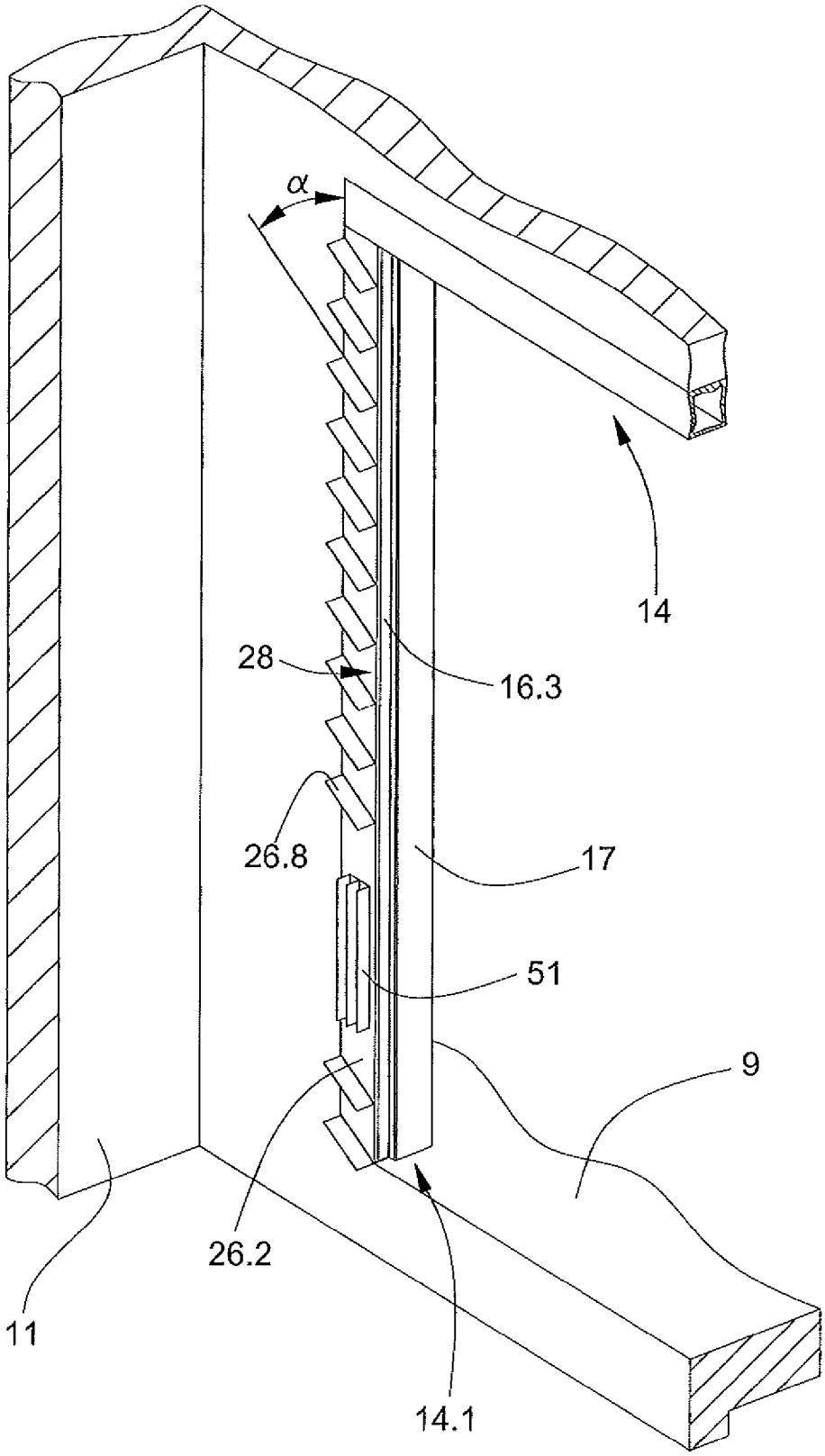
FIG. 3 shows the door frame in three-dimensional view with a viewing direction from the elevator shaft onto the story, the door posts of which include the door post parts shown in FIG. 2, and the elevator control arrangement in a second embodiment, wherein the dissipation of the waste heat into the elevator shaft takes place not only by way of the main member, but also by way of the a radiator.

FIG. 3 shows the door frame 14 in a three-dimensional view with a viewing direction from the elevator shaft 11 onto the story 9. The door post 14.1 of the door frame 14 includes the door post parts 16.1, 16.3, 16.4 shown in FIG. 2, the cover 17 and an elevator control arrangement 28 in a second embodiment. However, in FIG. 3 only the outer lateral post wall 16.3, the main member 26.2 and the cover 17 of the door post 14.1 are visible. In order to preserve clarity, illustration of the door leaves was similarly dispensed with, which according to FIG. 1 separate the story 9 from the elevator shaft 11 when no cage is in the region of the elevator shaft closure.

The elevator control arrangement 28 comprises substantially the same units (elevator control unit, electronic power unit, power supply unit, etc.), which are concealed by the main member 26.2, as the afore-described elevator control arrangement 18 of FIG. 2. Merely the main beam 26.2 illustrated in FIG. 3 differs in its form therefrom.

By contrast to FIG. 2, the cooling ribs 26.8 illustrated in FIG. 3 are arranged at an angle $\alpha$ to the main member 26.2. The illustrated angle $\alpha$ is approximately 30°, but it can also be selected to be different, for example between 1° and 60°, having regard to investigations of flow in the elevator shaft. Due to the fact that the cooling ribs 26.8 are not arranged parallel to the longitudinal direction of the main member 26.2, better utilization can be made of the air draught of an elevator cage, since the air draught takes place substantially parallel to the longitudinal direction of the main member 26.2. The air, which consequently flows substantially in vertical direction, of the air draught is deflected and swirled by the obliquely arranged cooling ribs 26.8. This leads to better intermixing of cold and heated air in the intermediate spaces of the cooling ribs 26.2 and thus to an increased cooling performance. In addition, the intermixed, heated air is deflected by the obliquely arranged cooling ribs 26.2 out of the region of the main member and distributed in the elevator shaft 11.

Figure 5:
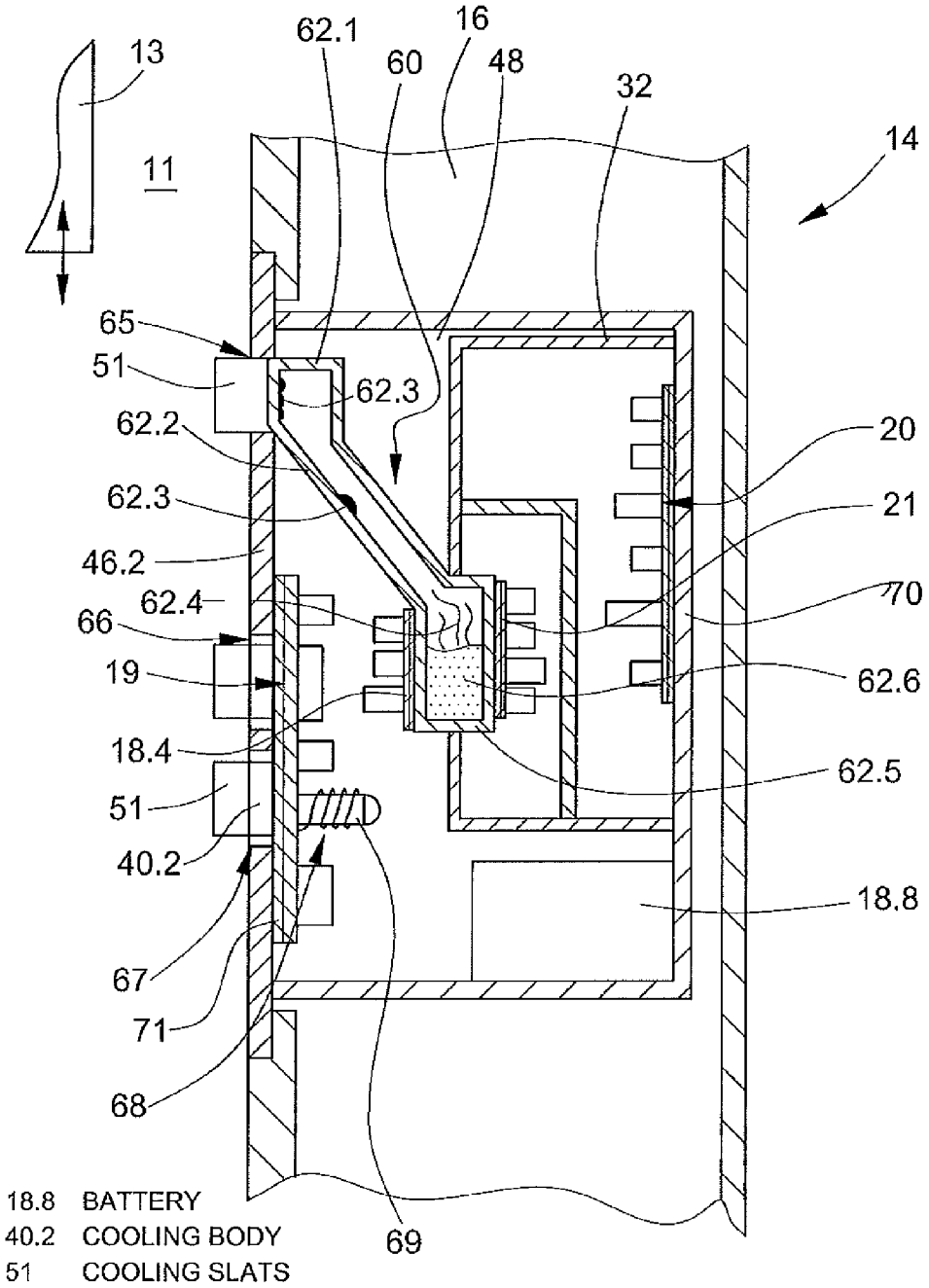
FIG. 5 shows, in sectional plan view, an elevator control arrangement, which is installed in the chamber of the door frame, in a fourth embodiment, wherein the dissipation of the waste heat takes place exclusively by way of cooling bodies and a radiator extending through the main member.

The cooling slats 51 arranged parallel to the longitudinal direction of the main member 26.2 are part of a cooling system which is arranged in the chamber 16 and which is described in detail in FIG. 5.

Figure 4:
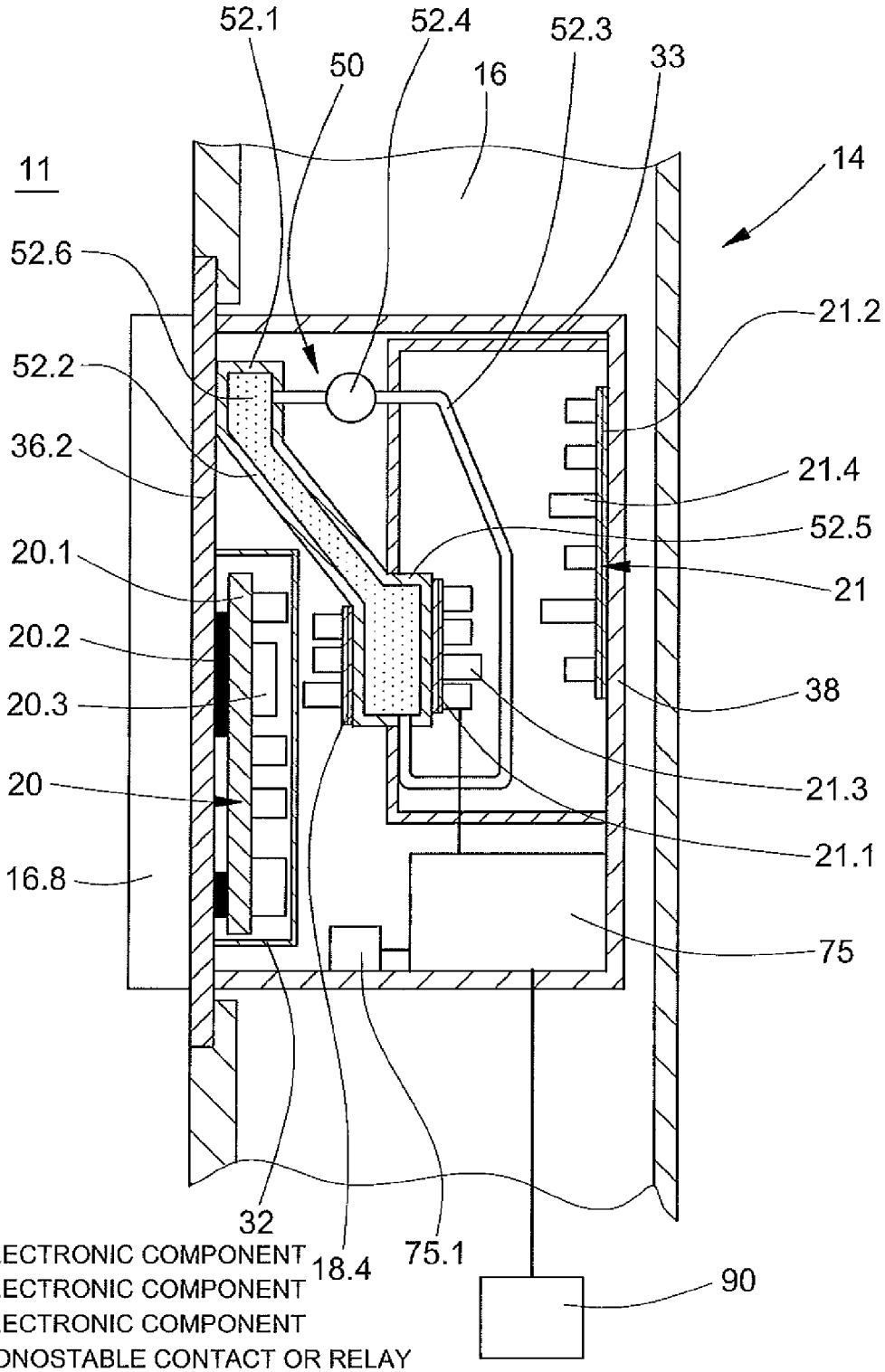
FIG. 4 shows, in sectional plan view, an elevator control arrangement, which is installed in the chamber of the door frame, in a third embodiment, wherein the dissipation of the waste heat takes place exclusively by way of the main member.

An elevator control arrangement 38 in a third embodiment installed in the chamber 16 of the door frame 14 is schematically illustrated in sectional plan in FIG. 4. This comprises an elevator control unit 20 and an electronic power unit 21. The elevator control unit 20 is arranged at the side of the main member 36.2 facing the chamber 16. The circuitboard 20.1 thereof has different electronic components, wherein some electronic components 20.3 generate waste heat. These electronic components 20.3 have cooling bodies 20.2, which are connected with the main member 36.2 and transmit the heat thereto by heat conduction or heat diffusion. In order to help ensure the heat transmission economically and in simplest manner flat and smooth contact surfaces bearing against one another are provided respectively at the main member 36.2 and the cooling body 20.2.

As illustrated in FIG. 4, the electronic power unit 21 can be divided up into different circuitboards 21.1, 21.2, wherein the "hot" electronic components 21.3 thereof generating a substantial amount of heat during operation are, for example, combined on a first circuitboard 21.1 and the remaining "cold" electronic components 21.4 are arranged on a second circuitboard 21.2. The "cold" electronic components 21.4 also have an internal electrical resistance which leads to power losses and thus to waste heat. The heat output of these electronic components 21.4 is, however, so small that this heat can be dissipated to the door frame elements by heat convection via the air in the chamber 16, which door frame elements due to the mass thereof hardly heat up. The second circuitboard 21.2 can be arranged where desired in the chamber 16, whilst the first circuitboard 21.2 with the "hot" electronic components 21.3 is possibly arranged at the main member 36.2. The afore-described division into two and more circuitboards is also possible in the case of the elevator control unit 20.

If too small an area is present at the main member 36.2, the first circuitboard 21.1 arranged at a distance from the main member 36.2 can, as illustrated, be thermally conductively connected with the main member 36.2 by means of a cooling system 50. The cooling system 50 illustrated in FIG. 4 is a pump-driven coolant circuit. The cooling system 50 comprises a cooler 52.1 arranged at the main member 36.2, a forward run 52.2, a return run 52.3 with a pump 52.4 and a system cooling body 52.5. The first circuitboard 21.1 can be arranged at the system cooling body 52.5. The electronic power unit 21 can also be arranged on a circuitboard, wherein the system cooling body 52.5 can extend over the entire circuitboard or only over regions of the circuitboard in which "hot" electronic components are arranged.

Liquids such as water or water/glycol mixtures can be used as coolant 52.6. However, substances which are gaseous at room temperature and normal pressure are also usable such as, for example, propane, butane or chlorofluorocarbons. In the case of use of gases, the coolant circuit can be designed like that of a heat pump with an aperture and with a compressor instead of the pump 52.4.

In addition, arranged within the chamber at the system cooling body 52.5 is a power supply unit 18.4, the heat-generating electronic components of which are similarly cooled by the cooling system 50. The waste heat, which is transmitted to the main member 36.2, of the elevator control unit 20 and the electronic power unit 21 as well as of the power supply unit 18.4 is transferred by heat convection from the main member 36.2 to the air in the elevator shaft 11. In order to increase the exchange area, the main member 36.2 has cooling ribs 16.8 directed towards the elevator shaft 11.

For the purpose of screening the elevator control unit 20 and the electronic power unit 21, electrically conductive screening hoods 32, 33 are present, such as span, by way of example in FIG. 4, the elevator control unit 20 and the electronic power unit 21. Generally, means serving for screening should be electrically conductively connected together. These can be earthed.

The elevator control arrangement 38 further comprises at least one monostable contactor or relay 75 which is arranged between a power mains 90 and the electronic control unit 21 for operation of an elevator motor. In order to help minimize switching noise of the at least one relay 75 the elevator control arrangement 38 can comprise a regulating device 75.1 which regulates the supply voltage of the switching coil of the relay 75 in dependence on the amperage to be switched.

FIG. 5 also shows in sectional plan an elevator control arrangement 48, which is installed in the chamber 16 of the door frame 14 in a fourth embodiment, wherein the main member 46.2 thereof has passages 65, 66, 67 through which the cooling body 40.2 of a second electronic power unit 19 and a radiator 62.1 of a cooling system 60 extend. The second electronic power unit 19 serves for feedback to the power mains of the electrical energy generated by the elevator motor. In at least some embodiments, the circuitboard 71 of the second electronic power unit 19 completely covers the passages 66, 67 so that the chamber 16 is gas-tightly separated from the elevator shaft 11. In addition, a choke coil 68 with a metal core 69, the metal core plates of which are welded together or the gaps between the metal core plates are filled with a synthetic material casting compound, is indicated on the circuitboard 71 of the second electronic power unit 19 of the second electronic power unit 19.

Not only the radiator 62.1, but also the cooling body 40.2 have cooling slats 51. The remaining components of the elevator control arrangement 48 approximately correspond in construction with the elevator control arrangement 38 of FIG. 4, for which reason the same reference numerals are used. In the embodiment of FIG. 5 the dissipation of waste heat of the electronic components takes place not by way of the main member 46.2, but directly via the cooling body 40.2 and the radiator 62.1, the cooling slats 51 of which extend into the elevator shaft 11. These are cooled by, for example, the air draught which is produced in the elevator shaft 11 by the movements of an elevator cage 13. The cooling system 60 illustrated in FIG. 5 is a heat pipe. This comprises a system cooling body 62.5 which is connected with the radiator 62.1 by a connecting pipe 62.2. Arranged in the system cooling body 62.5 is a liquid 62.6 which is vaporized by the action of the waste heat of electronic components of the electronic power unit 21 and of the power supply unit 18.4. The resulting vapor 62.4 rises through the connecting pipe 62.2 to the radiator 62.1 and condenses at the cooled inner walls of the radiator 62.1 to form condensate droplets 62.3, wherein the waste heat transported by the vapor is delivered to the radiator 62.1. The condensate drops 62.3 flow under the influence of gravitational force back into the system cooling body 62.5.

Figure 6:
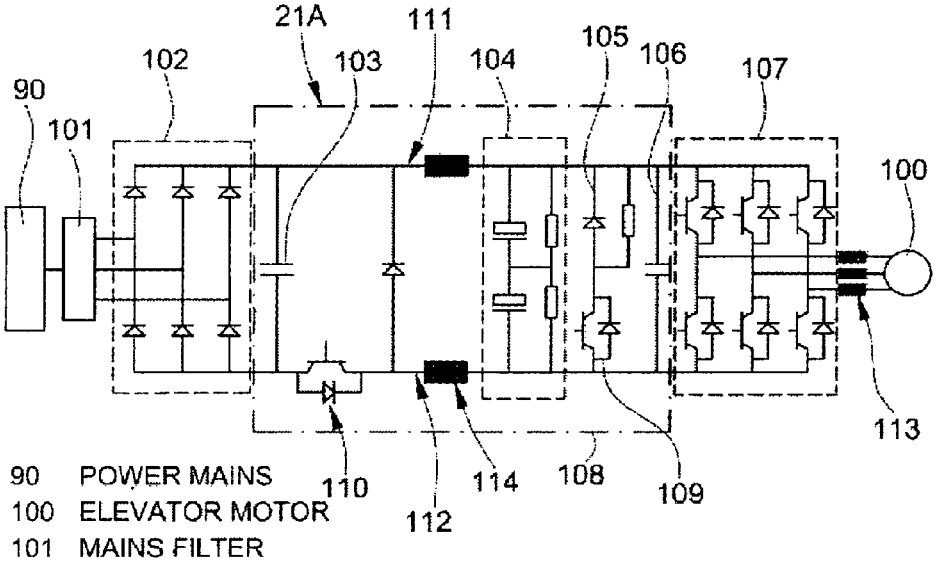
Fig. 6 (Prior Art)
FIG. 6 shows a basic diagram of an isolating point frequency converter in a first embodiment.
Figure 7:
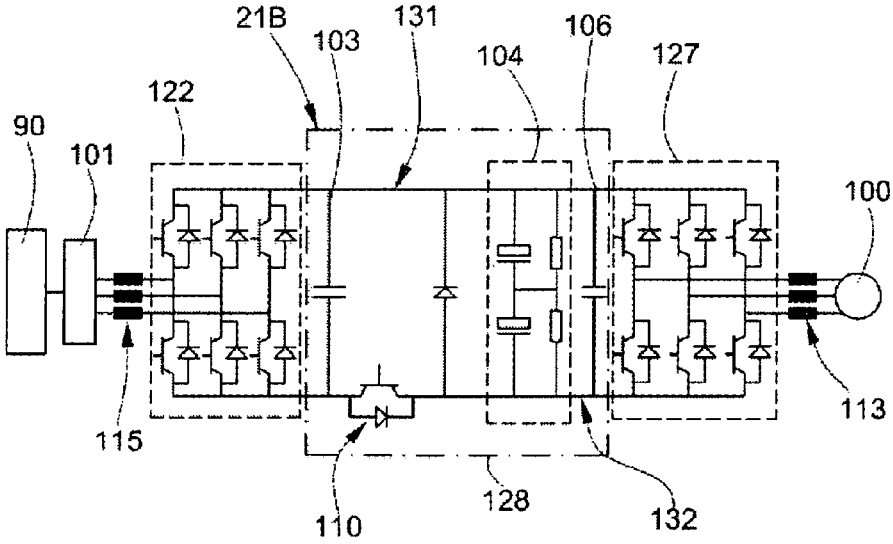
Fig. 7 (Prior Art)
FIG. 7 shows a basic diagram of an isolating point frequency converter in a second embodiment, which has feedback capability.

In addition, a battery 18.8 which can be periodically charged by the power supply unit 18.4 is arranged in the chamber 16. The battery 18.8 serves for power supply of the elevator control arrangement 48 in order to maintain specific emergency functions in the case of failure of the power mains. The electronic power unit 21 is a separating-point frequency converter and has two separating points required by Standard EN 81, as schematically illustrated in FIGS. 6 and 7 and described further below. Accordingly, in this embodiment of the elevator control arrangement 48 there is also no provision of electromechanical switching elements such as, for example, a monostable contactor or a relay.

The elevator control unit 20 is protected by a screening hood 32 and an electrically conductive mounting plate 70 of the elevator control arrangement 48 from electric and/or magnetic fields and electric and/or magnetic waves of the electronic power units, 19, 21.

A basic diagram of an electronic power unit in a first embodiment is illustrated in FIG. 6, which has two separating points in accordance with European Standard EN 81. The electronic power unit illustrated in FIG. 6 is a separating-point frequency converter 21A, which, for example, can be integrated in an elevator control installation of FIGS. 1 to 3 and FIG. 5 without use having to be made of at least one electromechanical switching element.

Like a frequency converter known in the prior art, the separating-point frequency converter 21A also has a direct voltage intermediate circuit 108. This is connected with a power mains 90 by way of a mains filter 101 and by way of a three-phase alternating current rectifier bridge 102 (power semiconductor at the mains side). Arranged between the elevator motor 100 and the direct-voltage intermediate circuit 108 is an inverter 107 with an IGBT which converts the direct current of the direct-voltage intermediate circuit 108 into three-phase alternating current with a variable frequency. In addition, two snubber capacitors 103, 106, intermediate circuit capacitors with parallel resistors 104 and a brake chopper 105, by means of which a brake IGBT 109 is switched on, are arranged between the positive path 111 and negative path 112 of the direct-voltage intermediate circuit 108.

According to EN 81 two independent switching elements are needed in order to interrupt the energy flow from the supply current mains 90 to the elevator motor 100. In the known prior art these two separating points are realized by a relay arranged between the mains filter and the three-phase alternating current rectifier bridge and by blocking the inverter IGBT. In order to help ensure the separation, the state of the relay is interrogated by way of a constrainedly guided auxiliary contact and the activating signal of the inverter IGBT is blocked. This functionality is checked not by safety components on the hardware side, but by a software faulty function test. In addition, the direct-voltage intermediate circuit should be charged in defined manner by frequency converters of the aforesaid kind so that the snubber capacitors (attenuation capacitors) and the intermediate circuit capacitors are not destroyed. Charging of the direct-voltage intermediate circuit is usually carried out with the help of a switched upstream resistance. After charging of the direct-voltage intermediate circuit this is directly connected with the mains by way of the relay.

The separating-point frequency converter 21A illustrated in FIG. 6 has, instead of the relay, an electronic power switch, possibly an intermediate circuit IGBT 110 in the direct-voltage intermediate circuit 108. This can be arranged either in the positive path 111 or in the negative path 112. An intermediate circuit choke coil 114 can be arranged not only in the positive path 111, but also in the negative path 112. The direct-voltage intermediate circuit 108 is charged in defined manner, with voltage regulation and/or current regulation or control, by pulses of the intermediate circuit IGBT 110 with pulse-width modulation. After the charging process the intermediate circuit IGBT 110 is permanently switched on. Correspondingly, the switched upstream resistance known in the prior art is redundant. If the intermediate circuit IGBT 110 is blocked, the direct-voltage intermediate circuit 108 and thus the energy flow are interrupted. In conjunction with blocking of the activation signal of the motor-side IGBT of the inverter 107 the double separation of the energy flow required by EN 81 is present.

In order to help ensure the double separation the voltage across the intermediate circuit IGBT 110 and/or the current therethrough is measured (energy flow no longer present) and the activation signal of all IGBTs of the inverter 107 and of the direct-voltage intermediate circuit 108 are blocked. Optionally, motor choke coils 113 can also be provided between the inverter 107 and the elevator motor 100 for each phase.

A basic diagram of an electronic power unit in a second embodiment is illustrated in FIG. 7, which has two separating points according to European Standard EN 81. The electronic power unit illustrated in FIG. 7 is a separating-point frequency converter 21B with feedback capability, which means that the brake energy of the elevator motor 100 and the energy of the direct-voltage intermediate circuit 128 can be fed back to the power mains 90. In order to achieve this, the feedback capable separating-point frequency converter 21B illustrated in FIG. 7 differs from that illustrated in FIG. 6 in that it has two inverters 122, 127. The first inverter 122 is arranged between the mains filter 101 and the direct-voltage intermediate circuit 128 and the second inverter 127 between the direct-voltage intermediate circuit 128 and the elevator motor 100. Moreover, two snubber capacitors 103, 106 and intermediate circuit capacitors with parallel resistors 104 are arranged between the positive path 131 and the negative path 132 of the direct-voltage intermediate circuit 128. By virtue of the feedback capability the need to arrange a brake chopper in the direct-voltage intermediate circuit 128 can be eliminated.

The feedback-capable separating-point frequency converter 121B illustrated in FIG. 7 also includes an electronic power switch, possibly an intermediate circuit IGBT 110, in the direct-voltage intermediate circuit 128. This can be arranged either in the positive path 131 or in the negative path 132. The direct-voltage intermediate circuit 121 is charged in defined manner by pulses of the intermediate circuit IGBT 110 with pulse-width modulation. The signals modulated in pulse width take place with voltage regulation and/or current regulation or with voltage control and current control. After the charging process the intermediate circuit IGBT 110 remains switched on. Correspondingly, the switched upstream resistor known in the prior art is redundant. If the intermediate circuit IGBT 110 is blocked, the direct-voltage intermediate circuit 128 and thus the energy flow are interrupted. In conjunction with the blocking of the activation signals of the motor-side IGBTs of the second inverter 127 the double separation of the energy flow as required by EN 81 is present. Through the blocking of the activation signals of the mains-side IGBTS of the first inverter 122 even a third separating point can be created.

Moreover, motor choke coils 113 can also be provided between the second inverter 127 and the elevator motor 100 and mains choke coils 115 between the mains filter 101 and the first inverter 122 for each phase.

Although the disclosed technologies have been described by the illustration of specific embodiments it will be apparent that numerous further variants of embodiment can be created with knowledge of the present disclosure, for example by combining the features of the individual embodiments together and/or exchanging individual functional units of the examples. For example, in all embodiments the cooling bodies of the electronic components of the elevator control unit and the electronic power unit can be thermally conductively connected with the main member. The cooling slats can, like the cooling ribs, can also be arranged at an angle to the length direction of the main member.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. A door frame for an elevator shaft closure, the elevator shaft closure being for separating an elevator shaft from a building story, the door frame comprising:

a chamber;

an opening arranged to be directed toward the elevator shaft; and an elevator control arrangement arranged in the chamber, the elevator control arrangement comprising, a main member, the main member being configured to close the opening, the main member including at least one of a passage through which a cooling body or radiator can extend into the elevator shaft and form a gas-tight seal with the passage, and cooling ribs arranged to be directed toward the elevator shaft with a cooling body thermally coupled with the main member, an elevator control unit arranged at the main member, and an electronic power unit connectible with an elevator motor, the electronic power unit being arranged at the main member.

2. The door frame of claim 1, the cooling body being coupled to an electronic component of the electronic power unit or to an electronic component of the elevator control unit.

3. The door frame of claim 1, the main member comprising cooling ribs arranged to be directed towards the elevator shaft, a cooler of a cooling system being thermally coupled with the main member.

4. The door frame of claim 3, the cooling system comprising a heat pipe.

5. The door frame of claim 3, the cooling system comprising a pump-driven coolant circuit.

6. The door frame of claim 3, the cooling system comprising a Peltier element.

7. The door frame of claim 3, the cooling ribs being arranged at an angle between 1 degree and 60 degrees relative to a direction of movement of an elevator cage in the elevator shaft.

8. The door frame of claim 1, the chamber comprising electrically conductive chamber walls, the electrically conductive chamber walls providing mutual electric screening or mutual magnetic screening of the elevator control unit and the electronic power unit.

9. The door frame of claim 1, further comprising screening for the electronic power unit or the elevator control unit.

10. The door frame of claim 1, further comprising a power supply unit for power supply of the elevator control unit.

11. The door frame of claim 1, further comprising a power supply unit for power supply of batteries.

12. The door frame of claim 1, further comprising an additional electronic power unit.

13. The door frame of claim 1, the elevator control arrangement further comprising:

a relay arranged between a power mains and the electronic power unit; and a regulating device for regulating a supply voltage of a switching coil of the relay in dependence on an amperage to be switched.

14. The door frame of claim 1, the electronic power unit comprising a frequency converter.

15. The door frame of claim 14, the frequency converter comprising a direct voltage intermediate circuit with an electronic power switch for interruption of energy flow from a power mains to the elevator motor.

16. The door frame of claim 1, the elevator control arrangement further comprising a choke coil, the choke coil comprising metal core plates welded together or interfilled with a synthetic material casting compound.

17. An elevator shaft closure for separating an elevator shaft from a building story, the elevator shaft closure comprising:

a door; and a door frame, the door frame comprising, a chamber, an opening arranged to be directed toward the elevator shaft, and an elevator control arrangement arranged in the chamber, the elevator control arrangement comprising, a main member, the main member being configured to close the opening, the main member including at least one of a passage through which a cooling body or radiator can extend into the elevator shaft and form a gas-tight seal with the passage, and cooling ribs arranged to be directed toward the elevator shaft with a cooling body thermally coupled with the main member, an elevator control unit arranged at the main member, and an electronic power unit connectible with an elevator motor, the electronic power unit being arranged at the main member.

18. An elevator installation, comprising:

a door frame for an elevator shaft closure, the elevator shaft closure being for separating an elevator shaft from a building story, the door frame comprising, a chamber, an opening arranged to be directed toward the elevator shaft, and an elevator control arrangement arranged in the chamber, the elevator control arrangement comprising, a main member, the main member being configured to close the opening, the main member including at least one of a passage through which a cooling body or radiator can extend into the elevator shaft and form a gas-tight seal with the passage, and cooling ribs arranged to be directed toward the elevator shaft with a cooling body thermally coupled with the main member, an elevator control unit arranged at the main member, and an electronic power unit connectible with an elevator motor, the electronic power unit being arranged at the main member.

* * * * *